US011675298B2

(12) United States Patent
Hasegawa

(10) Patent No.: US 11,675,298 B2
(45) Date of Patent: Jun. 13, 2023

(54) HEATING APPARATUS, IMAGE PROCESSING APPARATUS, AND METHOD OF CONTROLLING HEATING APPARATUS

(71) Applicant: TOSHIBA TEC KABUSHIKI KAISHA, Tokyo (JP)

(72) Inventor: Satoshi Hasegawa, Tagata Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/544,547

(22) Filed: Dec. 7, 2021

(65) Prior Publication Data

US 2022/0155713 A1 May 19, 2022

Related U.S. Application Data

(63) Continuation of application No. 16/951,117, filed on Nov. 18, 2020, now abandoned.

(51) Int. Cl.
*G03G 15/20* (2006.01)

(52) U.S. Cl.
CPC ..... *G03G 15/2053* (2013.01); *G03G 15/2039* (2013.01); *G03G 15/2064* (2013.01)

(58) Field of Classification Search
CPC . G03G 15/2053; G03G 15/2042; G03G 15/80
See application file for complete search history.

(56) References Cited

U.S. PATENT DOCUMENTS

| | | | |
|---|---|---|---|
| 10,429,780 B1 | 10/2019 | Hasegawa | |
| 2010/0166450 A1 | 7/2010 | Lee | |
| 2013/0034362 A1 | 2/2013 | Matsuura et al. | |

FOREIGN PATENT DOCUMENTS

| | | | |
|---|---|---|---|
| JP | H08190293 A | 7/1996 | |
| JP | 2005189779 * | 4/2005 | ..... G03G 15/20 |
| JP | 2008299162 A | 12/2008 | |
| JP | 2010117598 A | 5/2010 | |
| JP | 2011197184 A | 10/2011 | |

OTHER PUBLICATIONS

Translation of JP 2005189779 (Year: 2005).*

* cited by examiner

*Primary Examiner* — Arlene Heredia
(74) *Attorney, Agent, or Firm* — Kim & Stewart LLP

(57) ABSTRACT

According to one embodiment, a heating apparatus includes a belt having a width along a first direction and a resistive heating body having a first side facing the belt and a second side opposite the first side. The resistive heating body includes a plurality of power terminals spaced along the first direction. The resistive heating body is configured to generate heat when power is applied to a pair of power terminals from the plurality of power terminals. An adjustment section of the heating apparatus is configured to selectively apply power to different pairs of power terminals in the plurality of power terminals to change a heating range of the resistive heating body along the first direction.

14 Claims, 8 Drawing Sheets

HEATING APPARATUS, IMAGE PROCESSING APPARATUS, AND METHOD OF CONTROLLING HEATING APPARATUS

CROSS-REFERENCE TO RELATED APPLICATION

This application is a continuation of U.S. patent application Ser. No. 16/951,117, filed on Nov. 18, 2020, the entire contents of which are incorporated herein by reference.

FIELD

Embodiments described herein relate generally to a heating apparatus, an image processing apparatus incorporating a heating apparatus, and a method of controlling a heating apparatus.

BACKGROUND

An image forming apparatus of a certain type includes a fixing apparatus that heats a toner image formed on a sheet. The toner image corresponds to image data supplied to the image forming apparatus. The fixing apparatus fixes the toner image to the sheet using heat.

DETAILED DESCRIPTION

In general, according to an embodiment, a heating apparatus includes a belt having a width along a first direction and a resistive heating body having a first side facing the belt and a second side opposite the first side. The resistive heating body includes a plurality of power terminals spaced along the first direction of the resistive heating body. The resistive heating body is configured to generate heat when power is applied to a pair of power terminals of the plurality of power terminals. An adjustment section of the heating apparatus is configured to selectively apply power to different pairs of power terminals in the plurality of power terminals to change a heating range of the resistive heating body along the first direction. In some examples, the heating apparatus may be, or incorporated in, a fixing device or a decoloring apparatus.

Hereinafter, certain, non-limiting example embodiments of a heating apparatus, an image processing apparatus, and a method of controlling a heating apparatus will be described with reference to the accompanying drawings.

Figure 1:
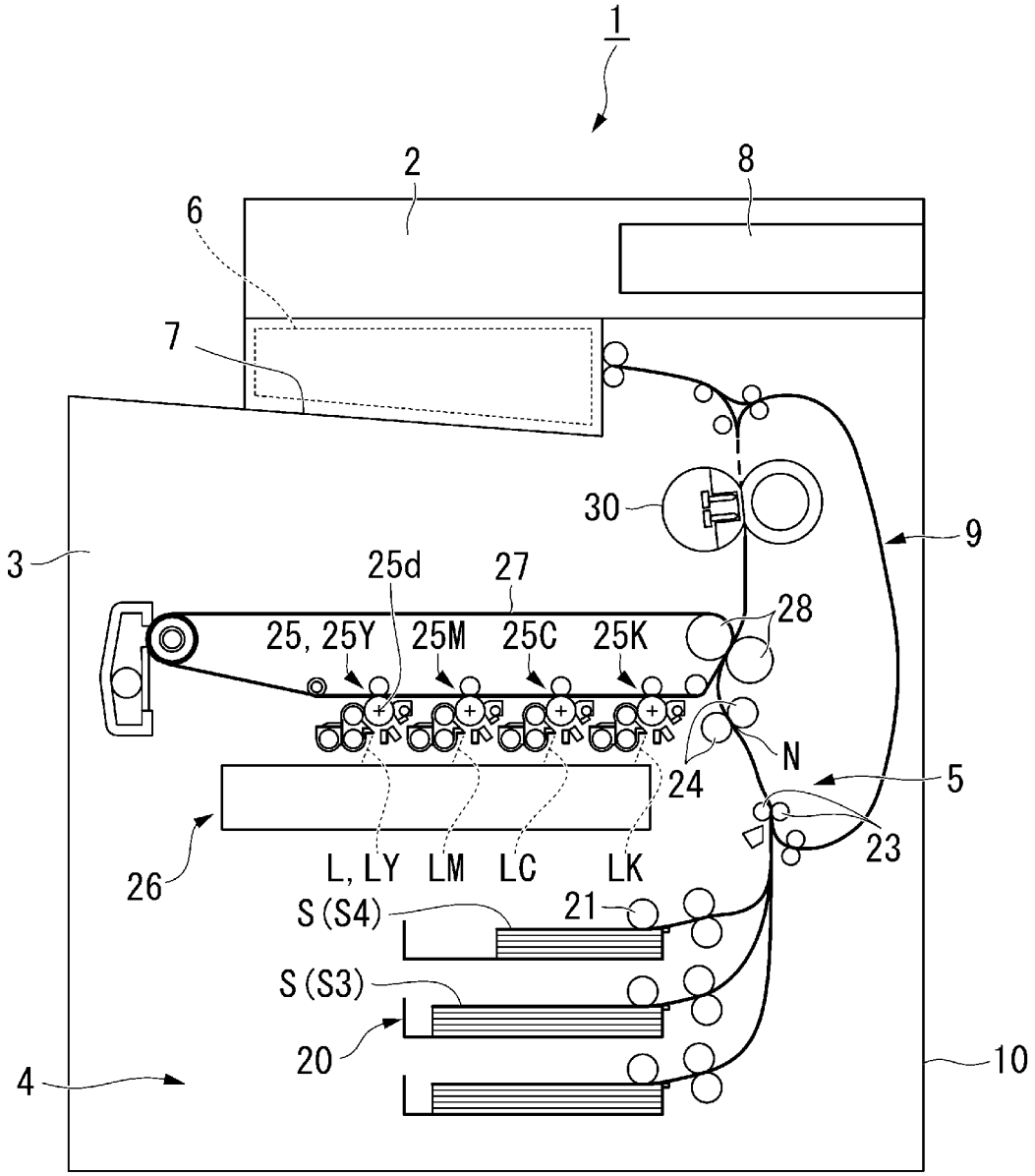
FIG. 1 is schematic configuration diagram of an image forming apparatus including a fixing apparatus according to an embodiment.

In the present disclosure, the heating apparatus is used as a fixing apparatus. As shown in FIG. 1, a fixing apparatus 30 is in an image forming apparatus 1. The image forming apparatus 1 performs a process of forming an image on a sheet S. The image forming apparatus 1 may also be referred to as an image processing apparatus 1, in some contexts.

The image forming apparatus 1 includes a housing 10, a scanner section 2, an image forming unit 3, a sheet supply section 4, a conveyance section 5, a sheet discharge tray 7, a reversing unit 9, a control panel 8, and a control section 6.

The housing 10 forms the external shape (outer casing) of the image forming apparatus 1.

The scanner section 2 reads image information of an object to be copied, such as a document or a photograph, based on reflected patterns of brightness and darkness of light from the object and generates image data accordingly. The scanner section 2 outputs the generated image data to the image forming unit 3.

The image forming unit 3 uses a recording agent, such as a toner, to form an image corresponding to the image data (hereinafter, referred to as a toner image) from the scanner section 2 or otherwise image data received from an external apparatus or the like connected to the image forming apparatus 1. The image forming unit 3 transfers the toner image to the surface of a sheet S. The image forming unit 3 then heats and presses the toner image on the sheet S to fix the toner image to the sheet S.

The sheet supply section 4 stores then supplies sheets S to the conveyance section 5 (one by one) to match the timing at which the image forming unit 3 forms the toner image for transfer to the sheet. The sheet supply section 4 includes at least one sheet accommodation section 20 and a pickup roller 21.

Each sheet accommodation section 20 can accommodate sheets S of a predetermined size and/or type.

The pickup roller 21 picks up the sheets S one by one from the sheet accommodation section 20. The pickup roller 21 supplies the picked-up sheets S to the conveyance section 5.

The conveyance section 5 conveys the sheets S to the image forming unit 3. The conveyance section 5 includes a conveyance roller pair 23 and a registration roller pair 24.

The conveyance roller pair 23 conveys the sheets S supplied from the pickup roller 21 to the registration roller pair 24. The conveyance roller pair 23 presses the tip end (leading edge) of a sheet S against a nip N formed by the registration roller pair 24.

The registration roller pair 24 holds the sheet S at the nip N to adjust the position of the tip end. The registration roller pair 24 then conveys the sheet S at a timing corresponding to the timing at which the image forming unit 3 can appropriately transfers a toner image to the sheet S. That is, the toner image is properly positioned on the sheet based on synchronization of the sheet S travel and the toner image transfer timing.

The image forming unit 3 includes a plurality of image forming sections 25, a laser scanning unit 26, an intermediate transfer belt 27, a transfer section 28, and a fixing apparatus 30.

Each image forming section 25 includes a photoreceptor drum 25*d*. Each image forming section 25 forms a toner image according to image data (received from the scanner section 2 or an external apparatus) on the photoreceptor drum 25*d*. A plurality of image forming sections 25Y, 25M, 25C, and 25K form toner images using yellow, magenta, cyan, and black toners, respectively.

An electrostatic charger, a developing device, and the like are disposed around each photoreceptor drum 25*d*. The electrostatic charger charges the surface of the photoreceptor drum 25*d*. The developing device stores developers for example, one of the yellow, magenta, cyan, and black toners. The developing device supplies developer to develop an electrostatic latent image that has been on the photoreceptor drum 25*d* by selective exposure of the photoreceptor drum 25*d* to light or the like. As a result, a toner image is formed on each photoreceptor drum 25*d* in the respective toner colors yellow, magenta, cyan, and black toners according to the image data.

The laser scanning unit 26 deflects a laser beam L for scanning across the electrostatically charged surface of the photoreceptor drums 25*d* to expose the photoreceptor drum 25*d* to light corresponding to the image data. The laser scanning unit 26 exposes the respective photoreceptor drums 25*d* of the image forming sections 25Y, 25M, 25C, and 25K to laser beams LY, LM, LC, and LK. Thereby, the laser scanning unit 26 forms an electrostatic latent image on each photoreceptor drum 25*d*.

A toner image on the surface of the photoreceptor drum 25*d* is then transferred onto the intermediate transfer belt 27 (referred to as a primary transfer).

The transfer section 28 transfers the toner image (which can be formed of stacked toner images of each color toner) from the intermediate transfer belt 27 to the surface of the sheet S at a secondary transfer position.

The fixing apparatus 30 then heats and presses the toner image that has been transferred onto the sheet S to fix the toner image to the sheet S.

The reversing unit 9 is used to reverse the travel direction and orientation of a sheet S in order to permit the formation an image on the back surface of the sheet S. The reversing unit 9 inverts the front and back of the sheet S that has been discharged from the fixing apparatus 30 by a switchback mechanism or the like. The reversing unit 9 then conveys the reversed sheet S back toward the registration roller pair 24.

The sheet discharge tray 7 accommodates sheets S which have had an image formed thereon and which have been discharged as a finished printing.

The control panel 8 is a user input section that permits a user or operator to input information (e.g., make selections and/or enter commands) used to operate the various functions of the image forming apparatus 1. In this example, the control panel 8 includes a touch panel screen and various buttons and/or keys.

The control section 6 controls the various sections and sub-units of the image forming apparatus 1.

Figure 2:
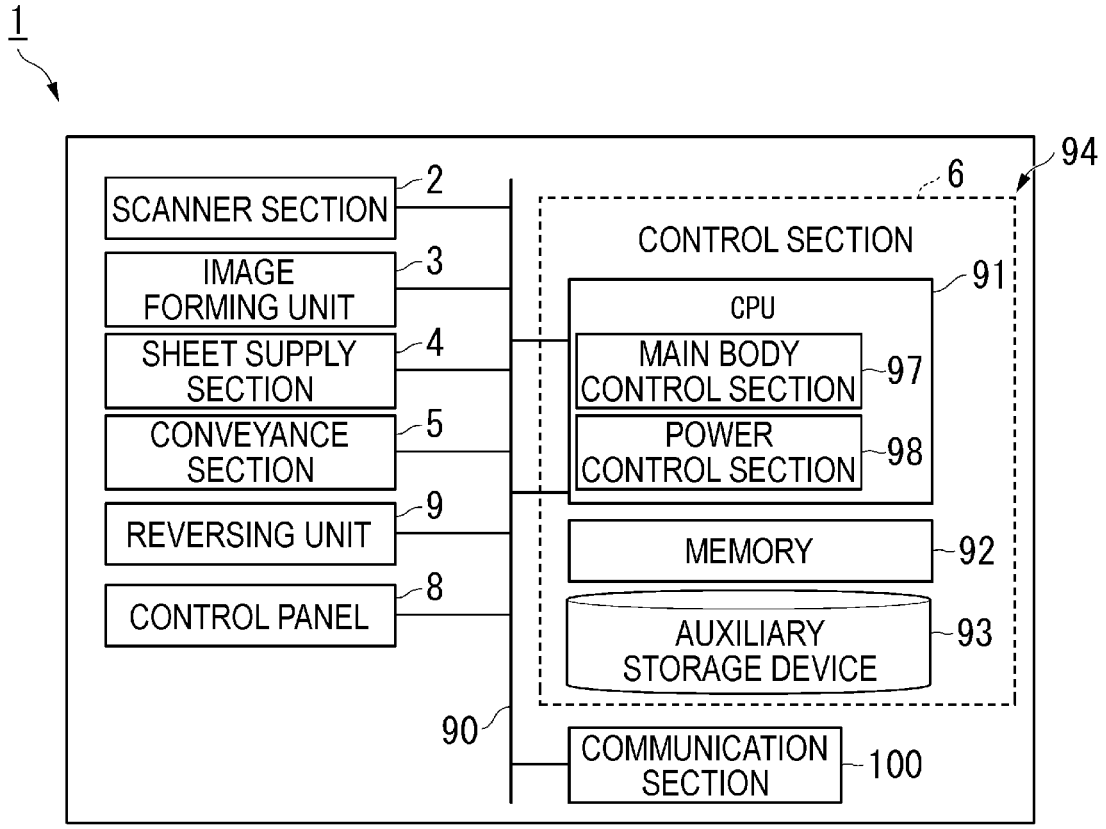
FIG. 2 depicts aspects of a hardware configuration of an image forming apparatus.

FIG. 2 is a diagram depicting certain hardware aspects of a configuration of the image forming apparatus 1 according to the present embodiment.

A communication section 100 includes a communication interface for connecting the image forming apparatus 1 to an external apparatus. The communication section 100 allows communications between the external apparatus and the image forming apparatus 1 to occur through the communication interface.

In this example, the control section 6 comprises a central processing unit (CPU) 91, a memory 92, an auxiliary storage device 93, which are connected to each other through a bus 90. The bus 90, the CPU 91, the memory 92, the auxiliary storage device 93, and other components are portions of a controller 94.

The memory 92 is a random access memory (RAM) serving as a work area of the CPU 91, or the like.

The auxiliary storage device 93 is a hard disk drive apparatus or the like. The auxiliary storage device 93 stores an operation system (OS), a control program, various data, and the like.

The CPU 91 executes a control program (in conjunction with the operating system or the like) to provide the functions of a main body control section 97 and a power control section 98.

In this context, the power control section 98 controls a belt unit 30*h* (see FIG. 3) and the like of the fixing apparatus 30.

The main body control section 97 controls the scanner section 2, the image forming unit 3, the sheet supply section 4, the conveyance section 5, the reversing unit 9, the control panel 8, and the like.

Figure 3:
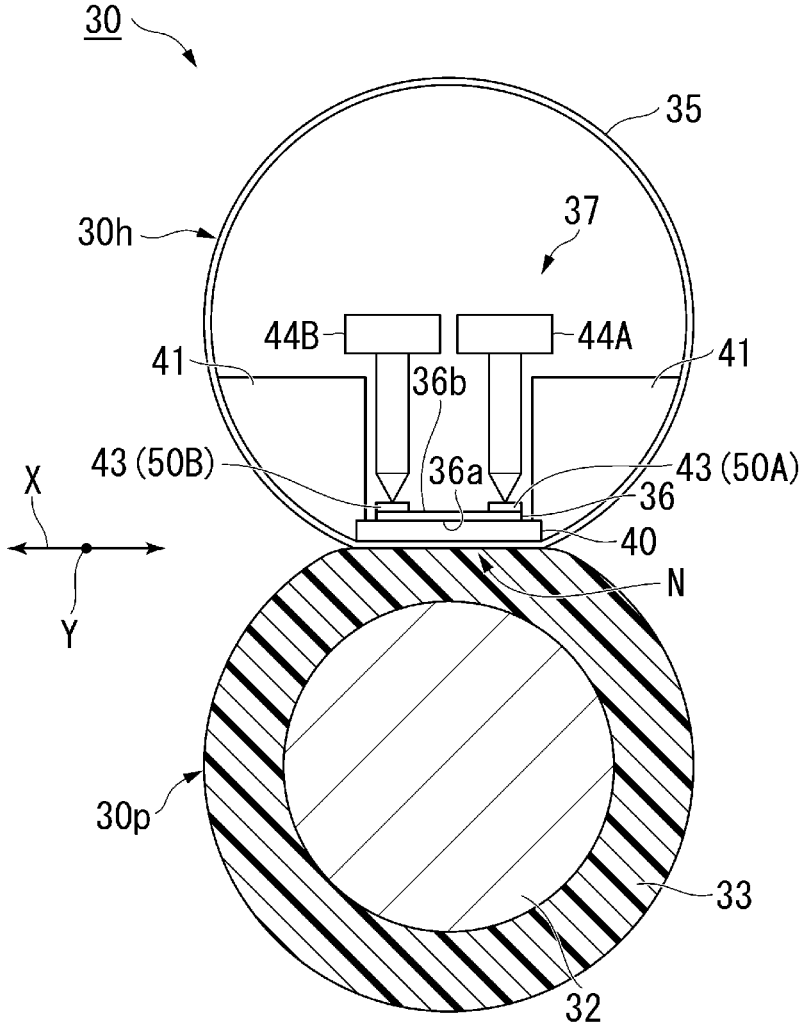
FIG. 3 is a cross-sectional view of a fixing apparatus.

As shown in FIG. 3, the fixing apparatus 30 includes a pressing roller 30*p* and a belt unit 30*h*.

The pressing roller 30*p* forms a nip N with the belt unit 30*h*. The pressing roller 30*p* presses a toner image on a sheet S passing through the nip N. The pressing roller 30*p* rotates to convey the sheet S through the nip N. The pressing roller 30*p* includes a core bar 32, an elastic layer 33, and a release layer.

The core bar 32 is formed of a metal material such as stainless steel and has a cylindrical shape. Both ends of the core bar 32 in an axial direction are rotatably supported. The core bar 32 is rotatable and can be driven by a motor. The core bar 32 abuts against a cam member. When the cam member rotates the core bar 32 moves towards or away from the belt unit 30*h*.

The elastic layer 33 is formed of an elastic material such as silicone rubber. The elastic layer 33 is formed on the outer circumferential surface of the core bar 32 to have a fixed thickness.

The release layer is formed of a resin material such as tetrafluoroethylene-perfluoroalkyl vinyl ether copolymer (PFA). The release layer is formed on the outer circumferential surface of the elastic layer 33 and is not separately depicted from the elastic layer 33 in this example.

The hardness of the outer circumferential surface of the pressing roller 30*p* is preferably in a range of 40° to 70° under a load of 9.8N as measured using an ASKER-C hardness meter. Thereby, the area of the nip N and the durability of the pressing roller 30*p* are secured with such a hardness level.

The pressing roller 30*p* can move toward and away from the belt unit 30*h* by the rotation of the cam member. When the pressing roller 30*p* is brought close to the belt unit 30*h* and pressed by a pressing spring, the nip N is formed.

On the other hand, when a jam of a sheet S occurs in the fixing apparatus 30, the pressing roller 30*p* can be moved away from the belt unit 30*h* to permit removal of the jammed sheet S. The pressing roller 30*p* is also generally moved away from the belt unit 30*h* while the fixing belt 35 is stopped but still rotatable. For example, while the fixing device 30 is in a sleeping state, the pressing roller 30*p* can be moved away from the belt unit 30*h* so that the plastic deformation of the fixing belt 35 can be prevented.

The pressing roller 30*p* rotates when driven by a motor. When the pressing roller 30*p* rotates when the nip N has been formed, the fixing belt 35 rotates according to the rotation of the pressing roller 30*p*. The pressing roller 30*p* serves to convey a sheet S along a conveyance direction X by rotating while the sheet S is at the nip N.

Figure 4:
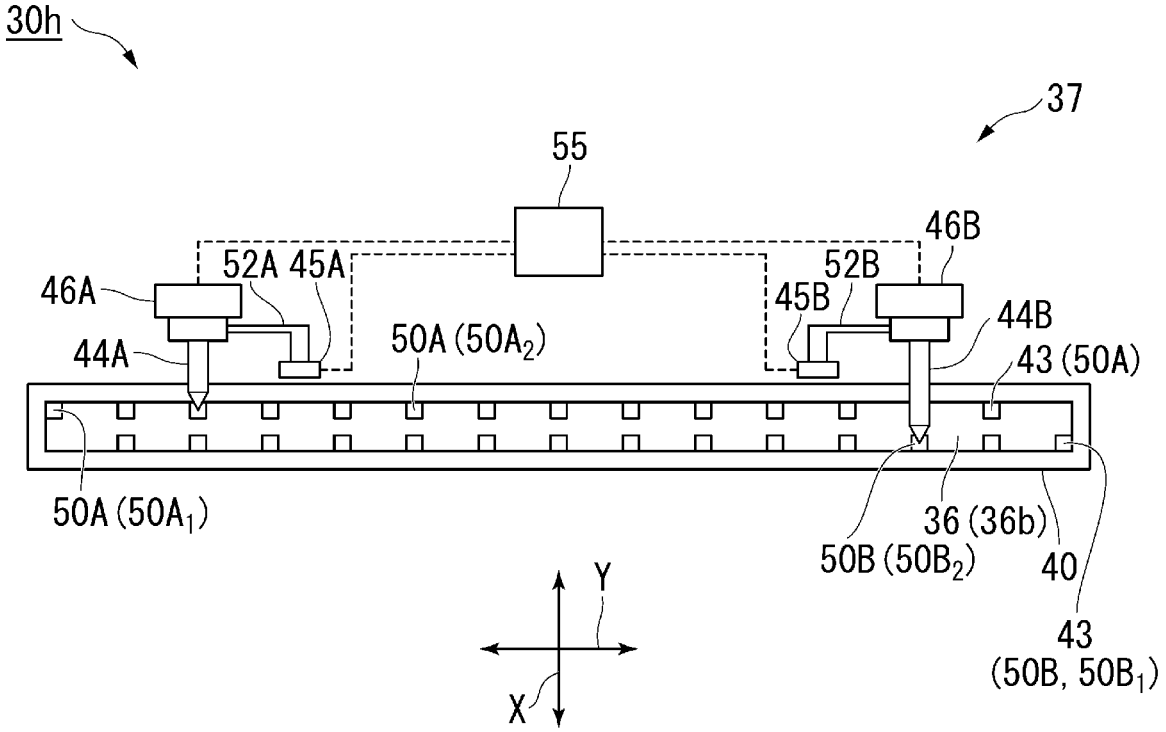
FIG. 4 is a front view of a belt unit.

The belt unit 30*h* heats a toner image on the sheet S entering the nip N. As shown in FIGS. 3 and 4, the belt unit 30*h* includes the fixing belt 35, a heating resistive body 36, and an adjustment section 37. In FIG. 4, the fixing belt 35 and the like are not depicted.

The fixing belt 35 is formed in a tubular shape (cylindrical shape). The fixing belt 35 includes a base layer, an elastic layer, and a release layer in this order from the inner circumference side. The base layer is formed of a material such as nickel (Ni) in a tubular shape. The elastic layer is laminated on the outer circumferential surface of the base layer. The elastic layer is formed of an elastic material such as silicone rubber. The release layer is laminated on the outer circumferential surface of the elastic layer. The release layer is formed of a material such as PFA resin.

In this description, the fixing belt 35 is disposed such that the axial direction of the fixing belt 35 is referred to as a first direction Y that is orthogonal to the conveyance direction X (of the sheets S). The fixing belt 35 comes into contact with the sheets S entering the nip N.

The heating resistive body 36 is disposed on the outer surface of the substrate 40.

The substrate 40 is formed of a metal material (such as stainless steel), a ceramic material (such as aluminum nitride), or the like. The substrate 40 has a plate shape. The substrate 40 has rectangular shape (long in the first direction Y) in the X-Y direction plane. The substrate 40 is disposed on the inner side of the fixing belt 35.

As shown in FIG. 3, a pair of heater holders 41 are fixed to the substrate 40. The pair of heater holders 41 are spaced from each other in the conveyance direction X with the substrate 40 therebetween. The pair of heater holders 41 extend in the first direction Y. In this example, both ends in the first direction Y of each of the pair of heater holders 41 are fixed to the housing 10 of the image forming apparatus 1. Thereby, the belt unit 30*h* is physically supported by the housing 10.

The heating resistive body 36 is formed of a known material to have a plate shape corresponding to the substate 40. When a voltage is applied to a portion of the heating resistive body 36, the portion generates heat by resistive heating. The heating resistive body 36 is disposed such that the longitudinal direction of the heating resistive body 36 is along the first direction Y.

An electrical insulating coating can be placed on portions of the heating resistive body 36 other than where power feed terminals 43 are disposed on the heating resistive body 36. A first surface 36*a* of the heating resistive body 36 comes into contact with a sheet S via the fixing belt 35 and the substrate 40. That is, the first surface 36*a* faces towards the fixing belt 35. The heating resistive body 36 supplies heat or more specifically generates heat for fixing a toner image based on image data corresponding to the toner image on the sheet S.

As shown in FIGS. 3 and 4, the adjustment section 37 includes a plurality of power feed terminals 43, a first power feeder 44A, a second power feeder 44B, a first temperature detection section 45A, a second temperature detection section 45B, a first conveyance section 46A, a second conveyance section 46B, and a power supply section 55. Here, in this example, the adjustment section 37 is disposed inside the fixing apparatus 30.

However, in some examples, the fixing apparatus 30 may incorporate the power control section 98 of the control section 6. In such an example, a portion of control of the fixing apparatus 30 is in the control section 6.

Some of the power feed terminals 43 are disposed to be mutually adjacent (matched) to each other in the conveyance direction X. The plurality of power feed terminals 43 includes a plurality of first power feed terminals 50A along one side of the substrate 40 and a plurality of second power feed terminals 50B along an opposite side of the substate 40. The first power feed terminals 50A and the second power feed terminals 50B are formed of a metal such as silver.

The plurality of first power feed terminals 50A are spaced from each other in the first direction Y. The plurality of second power feed terminals 50B are also spaced from each other in the first direction Y.

The first power feed terminals 50A are disposed on a first side of the substrate 40 and the second power feed terminals 50B are on a second side of the substrate 40 opposite the first side across the conveyance direction X. That is, the plurality of power feed terminals 43 are disposed in two separate rows (extending in the first direction Y) that are spaced from each other in the conveyance direction X.

The first power feed terminals 50A and the second power feed terminals 50B are electrically connected to the heating resistive body 36. The first power feed terminals 50A and the second power feed terminals 50B are disposed on a second surface 36*b* opposite to the first surface 36*a* of the heating resistive body 36.

For example, each of the first power feeder 44A and the second power feeder 44B is formed of a metal having a surface coated with silver or the like to have a bar shape. The first power feeder 44A is configured to selectively come into contact with any one of the first power feed terminals 50A. Similarly, the second power feeder 44B selectively is configured to come into contact with any one of the second power feed terminals 50B.

As shown in FIG. 4, a first power feed terminal 50A disposed at one end in the first direction Y is referred to as a first power feed terminal $\mathbf{50}A_1$ below. A second power feed terminal 50B disposed at another end in the first direction Y is referred to as a second power feed terminal $\mathbf{50}B_1$. A first direction Y distance between the first power feed terminal $\mathbf{50}A_1$ and the second power feed terminal $\mathbf{50}B_1$ is set to be greater than the width of the sheet S in the first direction Y.

A second power feed terminal 50B disposed closer to the center than the second power feed terminal $\mathbf{50}B_1$ is referred to as a second power feed terminal $\mathbf{50}B_2$. The second power feed terminal $\mathbf{50}B_2$ is farther from the nearest edge than the first power feed terminal $\mathbf{50}A_1$. The first direction Y distance between the first power feed terminal $\mathbf{50}A_1$ and the second power feed terminal $\mathbf{50}B_2$ is less than the width of the sheet S in the first direction Y.

The first temperature detection section 45A and the second temperature detection section 45B are contact type thermometers. For example, the first temperature detection section 45A comes into contact with the inner side of the fixing belt 35. Thus, in this example, the first temperature detection section 45A directly detects the temperature of the fixing belt 35.

The second temperature detection section 45B is configured in a similar manner to the first temperature detection section 45A. The first temperature detection section 45A and the second temperature detection section 45B transmit detection results to the power control section 98 of the control section 6.

The first temperature detection section 45A and the second temperature detection section 45B are positioned between the first power feeder 44A and the second power feeder 44B in the first direction Y. The first temperature detection section 45A is fixed to the first power feeder 44A by the fixing member 52A. The second temperature detection section 45B is fixed to the second power feeder 44B by the fixing member 52B. For example, the fixing members 52A and 52B are formed of a steel plate or the like.

In some examples, each of the first temperature detection section 45A and the second temperature detection section 45B directly detect the temperature of the substrate 40 or the like. In some examples, the first temperature detection section 45A and the second temperature detection section 45B may be non-contact type thermometers.

For example, each of the first conveyance section 46A and the second conveyance section 46B includes a linear guide and a driving motor. For example, regarding the first conveyance section 46A, the linear guide can be fixed to the first power feeder 44A and the first temperature detection section 45A. The linear guide guides the first power feeder 44A and the first temperature detection section 45A so that they can be moved in the first direction Y. The linear guide can include a position sensor. The position sensor can detect the position of the first power feeder 44A along the first direction Y. The position sensor transmits detection results to the power control section 98 of the control section 6, for example.

Thus, a driving motor can move the first power feeder 44A, the first temperature detection section 45A, and the fixing member 52A as one integrated body. That is, the first conveyance section 46A operates to move the first power feeder 44A and the first temperature detection section 45A as one body in the first direction Y. The first conveyance section 46A moves the first power feeder 44A so that the first power feeder 44A selectively comes into contact with one of the plurality of first power feed terminals 50A.

Similarly, the second conveyance section 46B can move the second power feeder 44B and the second temperature detection section 45B as one integrated body in the first direction Y. The second conveyance section 46B moves the second power feeder 44B so that the second power feeder 44B selectively comes into contact with one of the plurality of second power feed terminals 50B.

The power control section 98 calculates a distance between the first power feeder 44A and the second power feeder 44B based on detection results obtained by the position sensors for the first conveyance section 46A and the second conveyance section 46B, for example.

The power supply section 55 can adjust the magnitude (e.g., voltage level or the like) of power which is output from the power supply section 55. As shown in FIG. 4, the power supply section 55 applies power between the first power feeder 44A and the second power feeder 44B.

The temperature detection sections 45A and 45B, the conveyance sections 46A and 46B, and the power supply section 55 are respectively connected to the power control section 98. The conveyance sections 46A and 46B and the power supply section 55 are respectively controlled by the power control section 98.

In general, it can be understood that there can be a substantially fixed correlation between the temperature of the fixing belt 35 and the resulting temperature of the sheet S coming into contact with the fixing belt 35 during a fixing process. This fixed correlation can be established through experiment, simulation, or the like performed in advance. The power control section 98 stores this pre-established correlation between measured fixing belt 35 temperature and sheet S fixing temperature.

The positions of the first power feeder 44A and the second power feeder 44B in the first direction Y are changed by the first conveyance section 46A and the second conveyance section 46B. Thereby, the power control section 98 (control section 6) can switch the range in the first direction Y in which power is applied to the heating resistive body 36 by controlling the adjustment section 37. The power control section 98 can switch the range over which power is applied to the heating resistive body 36 based image data. More particularly, the range over which power is applied to the heating resistive body 36 can be set according to the image width (see, e.g., data range R1 in FIG. 6) in the image data used in forming the corresponding toner image now being fixed to the sheet S. That is, the relevant data range here is the range over which a toner image to be fixed onto the sheet S has been formed based on the image data. When the range over which a toner image is formed on the sheet S in the first direction Y is not continuous and there is a gap region (a region in which no toner is present) is included in the range, the data range can be defined as follows: the data range is defined on the assumption that the toner image is present even in the gap region.

The power control section 98 can switch the range along the first direction Y over which power is applied to the heating resistive body 36 to a first range and a second range different from the first range based on the data range. For example, in the first range, the first power feeder 44A comes into contact with the first power feed terminal $\mathbf{50}A_1$, and the second power feeder 44B comes into contact with the second power feed terminal $\mathbf{50}B_1$. Thereby, the range of the first direction Y over which power is applied to the heating resistive body 36 is the range of the sheet S over the entire sheet width in the first direction Y.

In the second range, the first power feeder 44A comes into contact with the first power feed terminal $\mathbf{50}A_1$, and the second power feeder 44B comes into contact with the second power feed terminal $\mathbf{50}B_2$. Thereby, the range along the first direction Y over which power is applied to the heating resistive body 36 is a range less than the entire width of the sheet S in the first direction Y and includes just the image data range, for example.

The power control section 98 moves the first power feeder 44A and the second power feeder 44B by the first conveyance section 46A and the second conveyance section 46B, respectively. Thereby, the power control section 98 can adjust the range along the first direction Y over which power is applied to the heating resistive body 36 through changing positions of the first power feeder 44A and the second power feeder 44B to correspond to the image data range.

It is preferable that the power control section 98 vary the power applied to the heating resistive body 36 based on a distance between the first power feeder 44A and the second power feeder 44B. More specifically, the power control section 98 adjusts the total power applied to the heating resistive body 36 to be constant (or substantially so) on a per unit length basis of the heating resistive body 36 regardless of the utilized distance between the first power feeder 44A and the second power feeder 44B. In other words, the power control section 98 keeps the current which flows through the heating resistive body 36 constant regardless of the distance changes between the first power feeder 44A and the second power feeder 44B.

Figure 5:
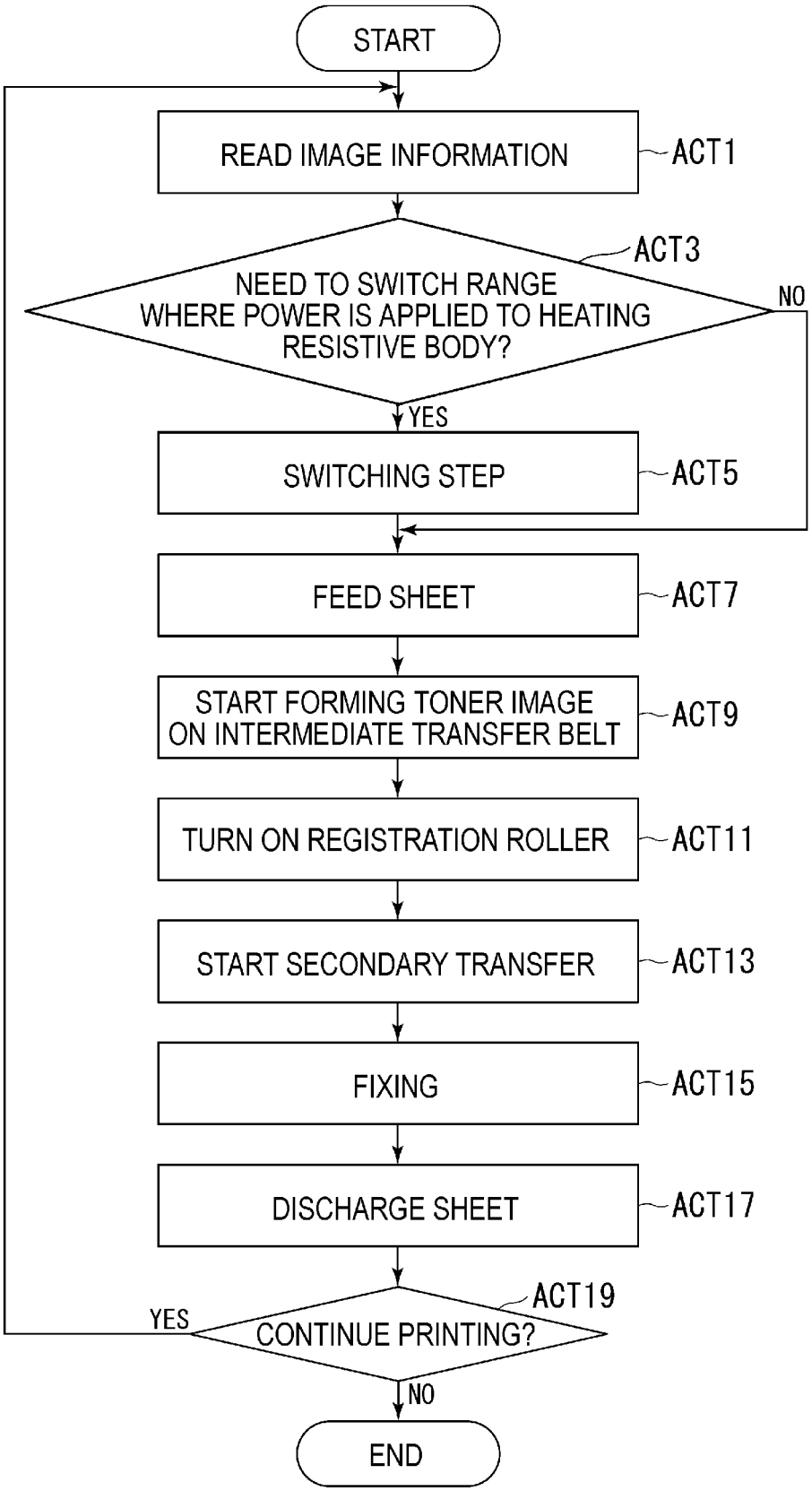
FIG. 5 is a flowchart of an operation during a printing of an image forming apparatus.

Next, operation of the image forming apparatus 1 configured as described above will be described. FIG. 5 is a flowchart showing an example of a printing process of the image forming apparatus 1 according to an embodiment. The image forming apparatus 1 prints an image on the sheet S by executing ACT1 to ACT19.

Figure 6:
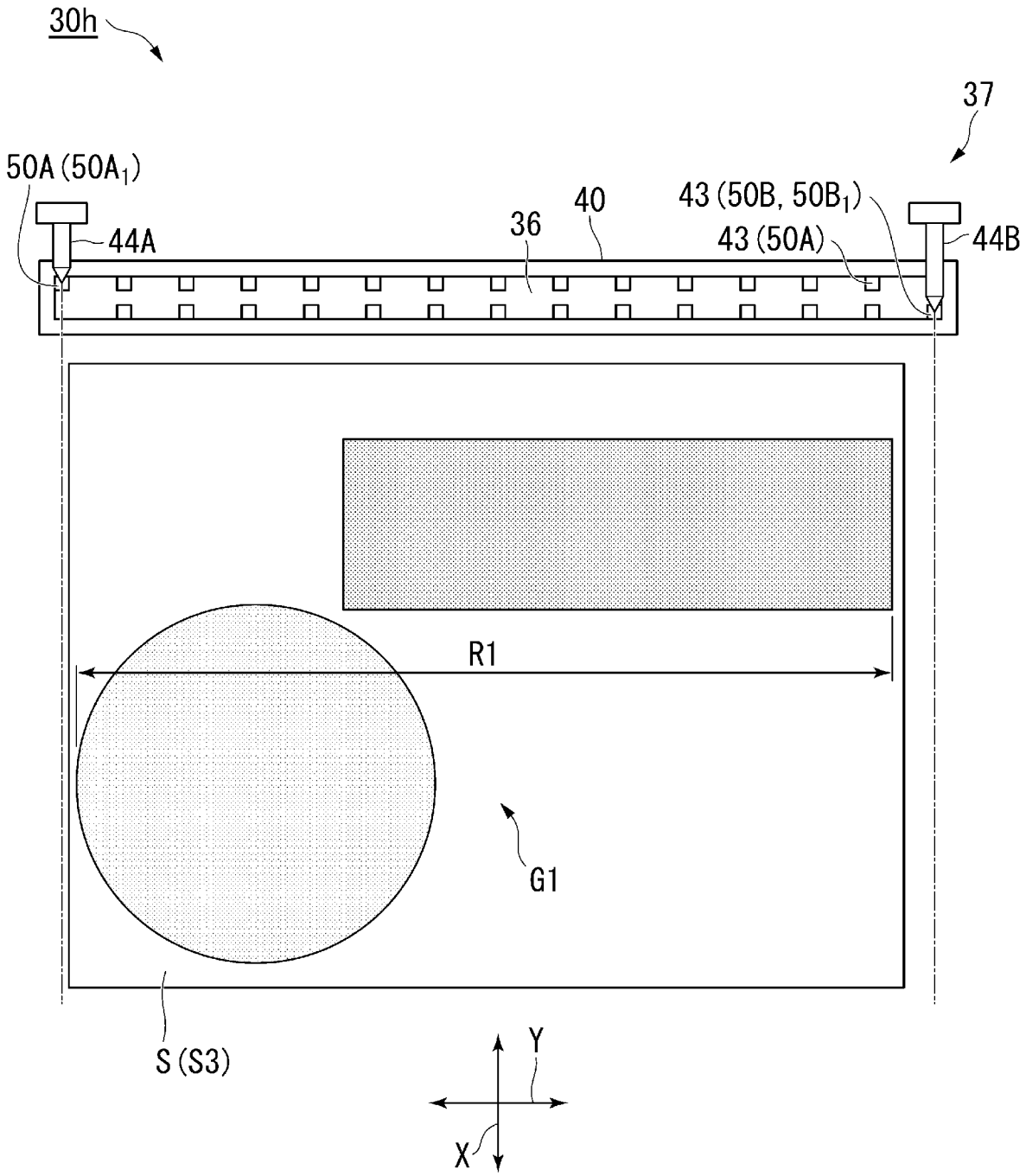
FIG. 6 is a diagram showing an example of a sheet and an image on the sheet to be fixed by a fixing apparatus to the sheet.

As shown in FIG. 1, sheets S3 having an A3 size and sheets S4 having an A4 size (here, "A3 size" and "A4 size" correspond to Japanese Industrial Standards (JIS) paper size standards) are accommodated in the sheet accommodation section 20. As shown in FIG. 6, the first power feeder 44A comes into contact with the first power feed terminal 50$A_1$, and the second power feeder 44B comes into contact with the second power feed terminal 50$B_1$. Note that in FIG. 6, FIG. 7, and FIG. 8 only certain components of the adjustment section 37 are depicted for clarity as compared to the more detailed depiction of the adjustment section 37 in FIG. 3 and FIG. 4.

In FIG. 6, the range along the first direction Y over which power is applied to the heating resistive body 36 is a "first range," which in this context is the entire width of the sheet S3 having an A3 size in the first direction Y. When the range along the first direction Y over which power is applied to the heating resistive body 36 is the first range, an image G1 spanning the entire sheet width in the first direction Y can be printed on the sheet S3.

In ACT1 (see FIG. 5)., the image forming apparatus 1 reads image information (image data) to be printed, copied, or the like by the image forming apparatus 1.

For example, the reading of the image information may be performed by causing the scanner section 2 to read an object to be copied. The scanner section 2 outputs generated image data to the image forming unit 3 for making a copy of the object. In ACT1, it is assumed that image information of an image G1 is read from a sheet S3 having an A3 size.

The image data includes information on printing settings or the like. The printing settings include information for printing the acquired image data, such as the size of a sheet S to be used, a printing orientation (e.g., landscape or portrait), and the number of sheets to be printed. The image data is output to both the main body control section 97 and the power control section 98. In other examples, the image data may be data received from an external apparatus rather than scanner section 2.

After the image data is output, ACT1 ends, and ACT3 is executed.

In ACT3, the power control section 98 determines whether it is necessary to switch the range in the first direction Y over which power is applied to the heating resistive body 36, based on a data range for the image data. Here, the data range for the image G1 is the data range R1. In ACT3, the power control section 98 determines that it is not necessary to switch the range (NO in ACT3). ACT3 ends, and ACT7 is executed.

On the other hand, if the power control section 98 determines in ACT3 that it is necessary to switch the range (YES in ACT3), ACT3 ends, and ACT5 is executed.

In ACT7, a sheet S3 selected in ACT1 according to the image information is fed. Specifically, the main body control section 97 supplies sheets S3 one by one to the conveyance section 5 from the sheet supply section 4 at a timing at which the image forming unit 3 forms a toner image.

The leading edge of the sheet S3 is stopped against the registration roller pair 24.

At this time, the power control section 98 applies power to the heating resistive body 36 through the first power feeder 44A and the second power feeder 44B by the power supply section 55. Here, heat is generated in the range between the first power feed terminal 50$A_1$ and the second power feed terminal 50$B_1$ in the heating resistive body 36.

As such, a warm-up operation of the fixing apparatus 30 is started, and the fixing apparatus 30 prepares to perform a fixing operation on a particular sheet S3. The power control section 98 adjusts the magnitude of power which is output from the power supply section 55 so that the temperature of the sheet S being fixed will be a predetermined fixing temperature when passed through the fixing device 30, based on detection results of the first temperature detection section 45A and the second temperature detection section 45B and the correlation.

After ACT7 is performed, ACT9 is performed. In ACT9, the forming of a toner image in the intermediate transfer belt 27 is started. Specifically, the plurality of image forming sections 25Y, 25M, 25C, and 25K form toner images using toners of respective colors. A toner image which is transferred to the intermediate transfer belt 27 is conveyed to the secondary transfer position for transfer to the sheet S3.

ACT11 can be performed in parallel with the operations of the image forming sections 25Y, 25M, 25C, and 25K. In ACT11, the registration roller pair 24 is started to rotate so the toner image can be transferred correctly to the sheet S3 at a position determined in advance.

When ACT11 ends and the tip end of the sheet S3 reaches the secondary transfer position, ACT13 is performed. In ACT13, the toner image on the intermediate transfer belt 27 is transferred to the sheet S3.

The sheet S3 passing through the secondary transfer position is next conveyed to the fixing apparatus 30.

When the sheet S3 enters the fixing apparatus 30, ACT15 is performed. In ACT15, the toner image is fixed to the sheet S3 by a fixing operation of the fixing apparatus 30.

After ACT15 is performed, ACT17 is performed.

In ACT17, the sheet S3 is discharged. The sheet S3 discharged from the fixing apparatus 30 is stored in/on the sheet discharge tray 7.

Thereby, the image formation on one sheet S3 ends. The image G1 has been formed on the sheet S3.

In ACT19, it is determined whether to continue printing the sheets S. When printing of the sheets S is continued (YES in ACT19), and the process returns to ACT1. On the other hand, when the printing of the sheets S ends (NO in ACT19) the processing ends.

Figure 7:
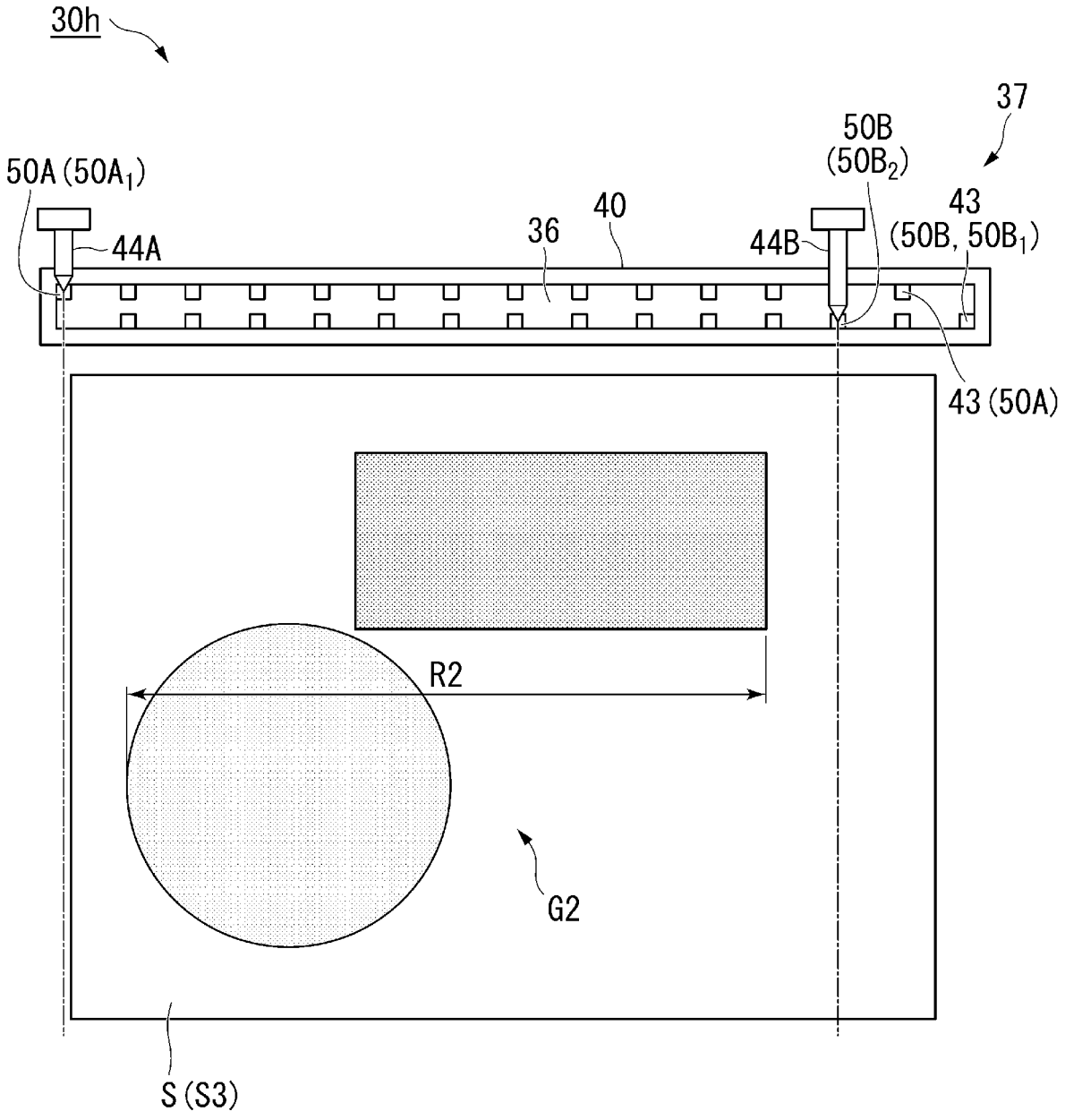
FIG. 7 is a diagram showing another example of a sheet and an image on the sheet to be fixed by a fixing apparatus.

In this example, in an ACT1 performed after ACT19, it can be assumed that image information of an image G2 is to be performed on a sheet S3 having an A3 size as shown in FIG. 7. The image G2 is an image which is formed in just a portion of the width of the sheet S3 in the first direction Y. That is, the image G2 is not a full-width image for an A3 size sheet.

In ACT1, the image forming apparatus 1 reads image information for the image G2 with a data range R2. The data range R2 is narrower than the data range R1 for the image G1.

In ACT3, the power control section 98 determines that it is necessary to switch the range in the first direction Y over which power is applied to the heating resistive body 36 based on the data range R2 (YES in ACT3). ACT3 ends, and ACT5 is executed.

In the switching step of ACT5, a method of controlling the fixing apparatus of the present embodiment is performed. In the switching step, the power control section 98 switches the range along the first direction Y over which power is applied to the heating resistive body 36 to correspond to the data range R2. Specifically, the power control section 98 moves the second power feeder 44B by the second conveyance section 46B and brings the second power feeder 44B into contact with the second power feed terminal 50$B_2$. Thereby, the range along the first direction Y over which power is applied to the heating resistive body 36 becomes a "second range," which is a range less than the entire width of the sheet S3 in the first direction Y and includes the data range R2. Heat is generated in the range between the first power feed terminal 50$A_1$ and the second power feed terminal 50$B_2$ in the heating resistive body 36.

In some examples, in the switching step of ACT5, the power control section 98 may switch the range in the first direction Y over which power is applied to the heating resistive body 36 from the second range to the first range based on the data range.

After ACT5 is performed, ACT7 is performed.

Once ACT7 to ACT17 have been performed again, the image G2 is formed on the sheet S3.

The above-described ACT1 to ACT17 are repeated until it is determined in ACT19 to not continue the printing of the sheet S (NO in ACT19).

Figure 8:
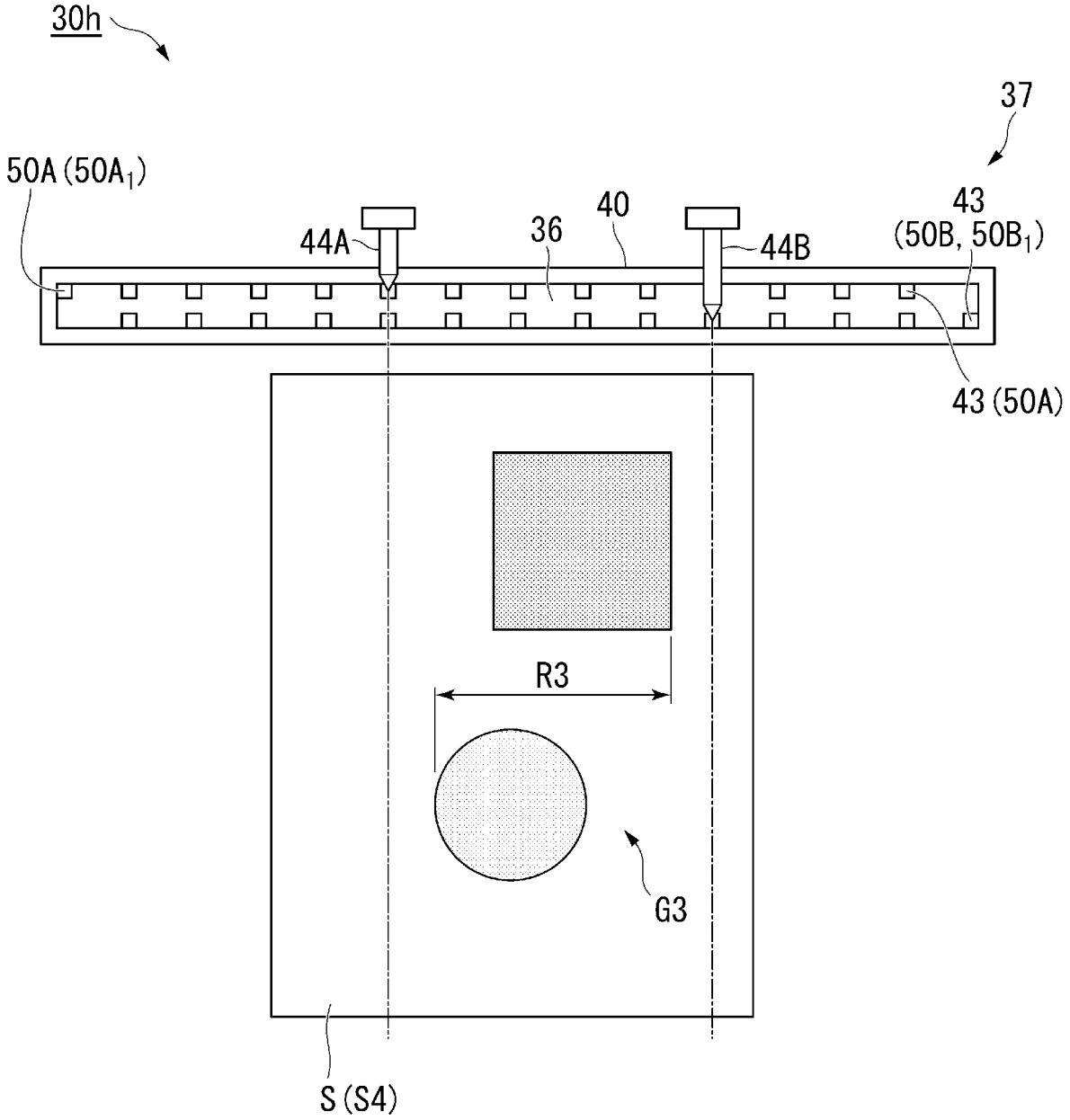
FIG. 8 is a diagram showing another example of a sheet and an on the sheet to be image fixed by a fixing apparatus.

In another example, such as shown in FIG. 8, when an image G3 is to be formed on a sheet S4 having an A4 size, the power control section 98 may move the first power feeder 44A by the first conveyance section 46A. Here, the range along the first direction Y over which power is applied to the heating resistive body 36 is less than the entire width of the sheet S4 in the first direction Y and includes a data range R3 for the image G3.

As described above, in the fixing apparatus 30 and the control method of the present embodiment, the adjustment section 37 can switch the range along the first direction Y over which power is applied to the heating resistive body 36. Therefore, for example, when the width of the data range is narrower than the width of the sheet S being printed, the adjustment section 37 switches the range along the first direction Y over which power is applied to the heating resistive body 36 so that the heated range becomes narrower than the width of the sheet S. Thereby, the length in the first direction Y of the heating resistive body 36 which is heated becomes less than that when the range in the first direction Y over which power is applied to the heating resistive body 36 is the entire (full) width of the sheet S. Thus, it is possible to reduce power consumption in the fixing apparatus 30.

The adjustment section 37 can switch the range along the first direction Y over which power is applied to the heating resistive body 36 between the first range and the second range as appropriate. For the first range, a toner image can be fixed to the sheet S over the entire width of the sheet S by applying power to the heating resistive body 36 over the entire width of the sheet S in the first direction Y. On the other hand, for the second range, power can be applied to the heating resistive body 36 over a range which is less than the full width of the sheet S and just includes the data range occupied by the image data being printed. Thus, with the second range, the length along the first direction Y over which the heating resistive body 36 is heated becomes shorter than the first range. Thus, it is possible to reduce power consumption in the fixing apparatus 30.

The adjustment section 37 includes the plurality of power feed terminals 43, the power feeders 44A and 44B, and the first conveyance section 46A. It is possible to switch the range along the first direction Y over which power is applied to the heating resistive body 36 by changing the particular power feed terminal 43 with which the first power feeder 44A comes into contact by movement of the first conveyance section 46A or the like.

The fixing apparatus 30 includes the first temperature detection section 45A that moves integrally with the first power feeder 44A. Thereby, the position of the surface of the fixing belt 35 where the first temperature detection section 45A detects a temperature is moved in the first direction Y in association with the switching of the range along the first direction Y over which power is applied to the heating resistive body 36. Thus, even when the first power feeder 44A is moved, the temperature of the fixing belt 35 heated by the heating resistive body 36 can still be accurately detected by the first temperature detection section 45A.

The first temperature detection section 45A is disposed between the first power feeder 44A and the second power feeder 44B in the first direction Y. A portion between the first power feeder 44A and the second power feeder 44B in the heating resistive body 36 is heated using power output by the power supply section 55. Thus, the temperature of a portion heated in the heating resistive body 36 can be accurately detected by the first temperature detection section 45A.

The fixing apparatus 30 includes the second conveyance section 46B. Thereby, the first power feeder 44A and the second power feeder 44B can be moved independently of each other by operations of the first conveyance section 46A and the second conveyance section 46B.

The fixing apparatus 30 includes the second temperature detection section 45B. The temperature of the fixing belt 35 is detected not only by the first temperature detection section 45A but also by the second temperature detection section 45B, and thus the temperature of the fixing belt 35 can be more accurately detected by use of multiple temperature detection sections.

The image forming apparatus 1 of the present embodiment includes the fixing apparatus 30 and the control section 6 (more particularly, a power control section 98). The control section 6 can switch the range along the first direction Y over which power is applied to the heating resistive body 36 by controlling the adjustment section 37 based on the data range R1.

The control section 6 controls power to be applied to the heating resistive body 36 based on a distance between the first power feeder 44A and the second power feeder 44B. Thereby, when the distance has changed, the control section 6 can adjust power to be applied to the heating resistive body 36.

In this example, the control section 6 keeps the power applied to the heating resistive body 36 constant on a per unit length basis for the active (utilized) portion of the heating resistive body 36 regardless of the distance set between the first power feeder 44A and the second power feeder 44B. Thereby, even when the distance between the first power feeder 44A and the second power feeder 44B is increased, the amount of heat generated by the active (utilized) portion of the heating resistive body 36 on per unit length basis in can be kept close to a fixed value.

The plurality of power feed terminals 43 are disposed in two rows spaced in the conveyance direction X. The plurality of first power feed terminals 50A come into contact with only the first power feeder 44A, and the plurality of second power feed terminals 50B come into contact with only the second power feeder 44B. Therefore, the plurality of power feed terminals 43 are less likely to wear due to the contact with the power feeders 44A and 44B, and thus the lifespan of the plurality of power feed terminals 43 can be extended.

However, in some examples, the plurality of power feed terminals 43 may be disposed in a single row along the conveyance direction X. In such a case, the first power feeder 44A and the second power feeder 44B selectively comes into contact with one of the plurality of power feed terminals 43 along the row direction.

In some examples, the adjustment section 37 may not include one or both of the temperature detection sections 45A and 45B. Likewise, in some examples, the second conveyance section 46B may not be incorporated.

As described above, the second range is a range which is less than the entire width of the sheet S in the first direction Y, but this second range may include gaps without any image data or the like.

In this example, the adjustment section 37 includes the plurality of power feed terminals 43, the power feeders 44A and 44B, the temperature detection sections 45A and 45B, and the conveyance sections 46A and 46B. However, the configuration of the adjustment section 37 is not limited to the above configuration. For example, a case where several discrete heating resistive bodies are arranged along the first direction Y is possible. Here, an adjustment section 37 may be configured to be able to select a particular heating resistive body or groups of heating resistive bodies from among the discrete heating resistive bodies to use for fixing operations by turning on or turning off electric contacts, switches, or the like to the selected heating resistive body or bodies.

It is assumed in the above examples that a heating apparatus is the fixing apparatus 30 used in an image forming apparatus 1 or the like. However, the heating apparatus of the present disclosure is not limited to the fixing apparatus 30, and in other embodiments may be a decoloring apparatus or heating device incorporated in a decoloring apparatus. In this context, a decoloring apparatus is a device that performs a process of decoloring an image that has been formed on the sheet S using a decoloring toner which is heat sensitive or the like.

While certain embodiments have been described these embodiments have been presented by way of example only, and are not intended to limit the scope of the present disclosure. Indeed, the novel embodiments described herein may be embodied in a variety of other forms; furthermore various omissions, substitutions and changes in the form of the embodiments described herein may be made without departing from the spirit of the present disclosure. The accompanying claims and their equivalents are intended to cover such forms or modifications as would fall within the scope and spirit of the present disclosure.

What is claimed is:

1. A heater, comprising:

a substrate which is longer in a first direction than in a second direction that is perpendicular to the first direction;

a heating resistive body formed on the substrate;

a first group of power terminals electrically connected to the heating resistive body and aligned with each other along the first direction; and a second group of power terminals electrically connected to the heating resistive body and aligned with each other along the first direction, the second group of power terminals spaced from the first group of power terminals in the second direction, wherein the heating resistive body generates heat between one terminal of the first group of power terminals and one terminal of the second group of power terminals according to power applied between the one terminal of the first group of power terminals and the one terminal of the second group of power terminals, and one terminal of the first group of power terminals at an end of the first group of power terminals in the first direction is farther from a nearest edge of the heating resistive body than one terminal of the second group of power terminals at a nearest end of the second group of power terminals in the first direction.

2. The heater of claim 1, further comprising:

a first power feeder which selectively contacts one terminal of the first group of power terminals; and a second power feeder which selectively contacts one terminal of the second group of power terminals.

3. The heater of claim 2, further comprising:

a power supply section which applies power between the first power feeder and the second power feeder.

4. The heater of claim 2, further comprising:

a power control section which keeps power flowing through the heating resistive body constant regardless of distance changes between the one terminal of the first group of power terminals and the one terminal of the second group of power terminals.

5. The heater of claim 1, further comprising:

an adjustment section configured to selectively apply power between one terminal of the first group of power terminals and one terminal of the second group of power terminals to change a heating range of the heating resistive body along the first direction.

6. A heating apparatus, comprising:

a heater including:

a substrate which is longer in a first direction than in a second direction that is perpendicular to the first direction, a heating resistive body formed on the substrate, a first group of power terminals electrically connected to the heating resistive body and aligned with each other along the first direction, and a second group of power terminals electrically connected to the heating resistive body and aligned with each other along the first direction, the second group of power terminals spaced from the first group of power terminals in the second direction; and a belt having a width in the first direction, wherein the heating resistive body generates heat between one terminal of the first group of power terminals and one terminal of the second group of power terminals according to power applied between the one terminal of the first group of power terminals and the one terminal of the second group of power terminals, an inner circumferential surface of the belt contacts the heater, the inner circumference of the belt contacts a first side of the heater, and the first group of power terminals are on a second side of the heater that is opposite of the first side.

7. The heating apparatus of claim 6, wherein one terminal of the first group of power terminals at an end of the first group of power terminals in the first direction is not aligned in the second direction with one terminal of the second group of power terminals.

8. The heating apparatus of claim 6, wherein one terminal of the first group of power terminals at an end of the first group of power terminals in the first direction is farther from a nearest edge of the heating resistive body than one terminal of the second group of power terminals at a nearest end of the second group of power terminals in the first direction.

9. The heating apparatus of claim 6, further comprising:

a first power feeder which selectively contacts one terminal of the first group of power terminals; and a second power feeder which selectively contacts one terminal of the second group of power terminals.

10. The heating apparatus of claim 9, further comprising:

a power supply section which applies power between the first power feeder and the second power feeder.

11. The heating apparatus of claim 9, further comprising:

a power control section which keeps power flowing through the heating resistive body constant regardless of distance changes between the one terminal of the first group of power terminals and the one terminal of the second group of power terminals.

12. The heating apparatus of claim 6, further comprising:

an adjustment section configured to selectively apply power between one terminal of the first group of power terminals and one terminal of the second group of power terminals to change a heating range of the heating resistive body along the first direction.

13. A heater, comprising:

a substrate longer in a first direction than in a second direction perpendicular to the first direction;

a resistive heating body formed on the substrate between a first end and a second end of the substrate, the resistive heating body being continuous along the first direction;

first power terminals along a first outer edge of the resistive heating body, the first power terminals being spaced from each other in the first direction; and second power terminals along a second outer edge of the resistive heating body, the first and second outer edges being spaced from each other in the second direction, the second power terminals being spaced from each other in the first direction and from the first power terminals in the second direction, wherein the resistive heating body generates heat when power is applied across any one of the first power terminals and any one of the second power terminals, the first power terminal that is nearest the first end of the substrate is not aligned in the second direction with the second power terminal that is nearest the first end of the substrate, the second power terminal that is nearest the second end of the substrate is not aligned in the second direction with the first power terminal that is nearest the second end of the substrate, and the first power terminals that are not nearest the first end of the substrate are respectively aligned in the second direction to one of the second power terminals.

14. The heater of claim 13, further comprising:

an adjustment section configured to selectively apply power to any one of the first power terminals and any one of the second power terminals.

* * * * *